US009913321B2

(12) United States Patent
Hotto

(10) Patent No.: US 9,913,321 B2
(45) Date of Patent: Mar. 6, 2018

(54) ENERGY HARVESTING CONTAINER

(71) Applicant: Energyield, LLC, Carlsbad, CA (US)

(72) Inventor: Robert Hotto, Carlsbad, CA (US)

(73) Assignee: Energyield, LLC, Carlsbad, CA (US)

( * ) Notice: Subject to any disclaimer, the term of this patent is extended or adjusted under 35 U.S.C. 154(b) by 949 days.

(21) Appl. No.: 13/750,239

(22) Filed: Jan. 25, 2013

(65) Prior Publication Data

US 2014/0209599 A1 Jul. 31, 2014

(51) Int. Cl.
*H05B 6/00* (2006.01)
*H05B 6/10* (2006.01)

(52) U.S. Cl.
CPC ..... *H05B 6/108* (2013.01)

(58) Field of Classification Search
CPC ..... H01L 41/042; H01L 41/044; H01L 41/08; H01L 41/25; H01L 41/273; H01L 41/293; H02N 2/18; H02N 2/186; H02N 2/001; Y10T 29/42; Y10T 428/2982; B06B 1/06; B06B 1/0603; H05B 6/108
USPC ..... 219/647; 310/318, 319, 317, 339; 15/159.1; 401/1; 290/1 R
See application file for complete search history.

(56) References Cited

U.S. PATENT DOCUMENTS 2,203,545 A * 6/1940 Peterson ..... 310/344
2,539,535 A * 1/1951 Espenschied ..... 290/1 R
2,725,219 A * 11/1955 Firth ..... 366/114
2,769,867 A * 11/1956 Crownover et al. ..... 381/163
2,806,246 A * 9/1957 Simjian ..... 452/141
2,921,134 A * 1/1960 Greenspan et al. ..... 367/140
2,928,052 A * 3/1960 Wood ..... 331/185
3,067,948 A * 12/1962 Lang et al. ..... 239/4
3,140,859 A * 7/1964 Scarpa ..... 366/114
3,283,182 A * 11/1966 Jones et al. ..... 310/325
3,360,664 A * 12/1967 Straube ..... 310/330
3,360,665 A * 12/1967 Boswell ..... 310/328
3,363,566 A * 1/1968 Giattino et al. ..... 102/210
3,385,262 A * 5/1968 Stanley et al. ..... 118/429
3,398,550 A * 8/1968 Lents ..... 62/179
3,433,461 A * 3/1969 Scarpa ..... 366/112
3,464,049 A * 8/1969 Kibbe ..... 338/5
3,524,084 A * 8/1970 Horan ..... 310/319
3,527,300 A * 9/1970 Phillips ..... 166/249
3,583,386 A * 6/1971 Slack ..... 126/204
3,583,677 A * 6/1971 Phillips ..... 366/120
3,610,325 A * 10/1971 Russell et al. ..... 165/74
(Continued)

OTHER PUBLICATIONS

Linear Technology, "LTC3588-1 Piezoelectric Energy Harvesting Power Supply" pp. 1-20, LT 0910 Rev A—Printed in USA 2010.
(Continued)

*Primary Examiner* — Eric Stapleton
(74) *Attorney, Agent, or Firm* — John L. Rogitz

(57) ABSTRACT

A container that experiences vibrations when transported allows an inner container which defines a chamber holding a substance to move relative to an outer shell under the influence of vibrations. An energy generator such as a magnet and a corresponding coil or a piezoelectric generator that does not move with the inner container is juxtaposed with the inner container to cause an electrical current to be introduced in the inner container when the inner container moves relative to the magnet. The electrical current is dissipated as heat to transfer heat into the substance in the chamber.

10 Claims, 3 Drawing Sheets

(56) References Cited

U.S. PATENT DOCUMENTS 3,626,079 A * 12/1971 Keen et al. ..... 174/15.3
3,626,481 A * 12/1971 Taylor et al. ..... 165/162
3,668,838 A * 6/1972 McNeil et al. ..... 96/195
3,669,099 A * 6/1972 Silverman ..... 600/581
3,675,637 A * 7/1972 Trimble ..... 126/263.05
3,693,324 A * 9/1972 McNeil ..... 96/174
3,781,955 A * 1/1974 Lavrinenko et al. ..... 29/25.35
3,879,699 A * 4/1975 Pepper ..... 367/137
3,898,534 A * 8/1975 Mohr ..... 361/260
3,936,678 A * 2/1976 Mohr ..... 310/339
3,949,248 A * 4/1976 Duffner et al. ..... 310/339
3,963,966 A * 6/1976 Mohr ..... 361/260
3,967,141 A * 6/1976 Gawlick et al. ..... 310/339
3,984,738 A * 10/1976 Mohr ..... 361/260
3,987,729 A * 10/1976 Andrews et al. ..... 102/210
4,015,151 A * 3/1977 Klauer ..... 310/339
4,019,073 A * 4/1977 Vishnevsky et al. ..... 310/322
4,396,852 A * 8/1983 Hunt ..... 310/329
4,536,674 A * 8/1985 Schmidt ..... 310/330
4,708,127 A * 11/1987 Abdelghani ..... 601/2
4,709,360 A * 11/1987 Martin et al. ..... 367/157
4,975,616 A * 12/1990 Park ..... 310/339
4,980,597 A * 12/1990 Iwao ..... 310/319
5,032,754 A * 7/1991 Iwao et al. ..... 310/323.02
5,189,332 A * 2/1993 Wild ..... 310/345
5,641,228 A * 6/1997 Prokopenko ..... 366/114
5,672,929 A * 9/1997 Gutsell et al. ..... 310/319
5,751,091 A * 5/1998 Takahashi et al. ..... 310/339
5,956,292 A * 9/1999 Bernstein ..... 367/140
6,022,572 A * 2/2000 Winter et al. ..... 426/231
6,037,704 A * 3/2000 Welle ..... 310/339
6,172,444 B1 * 1/2001 Puskas ..... 310/316.01
6,345,666 B1 * 2/2002 Conrad ..... 165/154
6,407,484 B1 * 6/2002 Oliver et al. ..... 310/339
6,436,051 B1 * 8/2002 Morris et al. ..... 600/459
6,639,872 B1 * 10/2003 Rein ..... 367/140
6,809,462 B2 * 10/2004 Pelrine et al. ..... 310/319
6,815,871 B2 * 11/2004 Yuasa et al. ..... 310/317
6,954,025 B2 * 10/2005 Nishida et al. ..... 310/339
6,984,902 B1 * 1/2006 Huang et al. ..... 310/26
7,057,330 B2 * 6/2006 Buhler et al. ..... 310/339
7,105,982 B1 * 9/2006 Hagood et al. ..... 310/319
7,109,642 B2 * 9/2006 Scott ..... 310/334
7,132,757 B2 * 11/2006 Steigerwald et al. ..... 290/1 R
7,176,600 B2 * 2/2007 Buhler et al. ..... 310/317
7,188,993 B1 * 3/2007 Howe et al. ..... 366/111
7,334,516 B2 * 2/2008 Ho et al. ..... 99/277.2
7,446,450 B2 * 11/2008 Boland et al. ..... 310/309
7,579,757 B2 * 8/2009 Kulah et al. ..... 310/339
7,608,976 B1 * 10/2009 Cheng et al. ..... 310/311
7,696,673 B1 * 4/2010 Yavid ..... 310/339
7,706,671 B2 * 4/2010 Brown ..... 392/498
7,719,416 B2 * 5/2010 Arms et al. ..... 340/539.1
7,729,768 B2 * 6/2010 White et al. ..... 607/35
7,795,763 B2 * 9/2010 Harris et al. ..... 310/12.16
7,847,421 B2 * 12/2010 Gardner et al. ..... 290/1 R
7,851,932 B2 * 12/2010 Rome et al. ..... 290/10
7,898,096 B1 * 3/2011 Krupenkin ..... 290/1 R
7,948,153 B1 * 5/2011 Kellogg et al. ..... 310/339
7,982,371 B1 * 7/2011 Anand et al. ..... 310/339
8,030,786 B2 * 10/2011 Jackson et al. ..... 290/1 R
8,030,807 B2 * 10/2011 Gieras et al. ..... 310/25
8,134,282 B1 * 3/2012 Churchill et al. ..... 310/339
8,188,622 B1 * 5/2012 Waters et al. ..... 310/15
8,222,754 B1 * 7/2012 Soliman et al. ..... 290/1 R
8,283,793 B2 * 10/2012 Pless ..... 290/1 R
8,284,075 B2 * 10/2012 Fincher et al. ..... 340/854.4
8,330,334 B2 * 12/2012 Lee et al. ..... 310/339
8,450,866 B2 * 5/2013 Despesse ..... 290/1 R
8,456,028 B1 * 6/2013 Chan et al. ..... 290/1 R
8,508,108 B2 * 8/2013 Anand et al. ..... 310/339
8,513,855 B2 * 8/2013 Wu et al. ..... 310/316.03
8,519,554 B2 * 8/2013 Kaplan ..... 290/1 R
8,736,148 B2 * 5/2014 Penn ..... 310/339
8,860,553 B2 * 10/2014 Lal et al. ..... 340/10.1
2001/0032663 A1 * 10/2001 Pelrine et al. ..... 136/205
2002/0043895 A1 * 4/2002 Richards et al. ..... 310/328
2002/0121844 A1 * 9/2002 Ghandi et al. ..... 310/339
2002/0175594 A1 * 11/2002 Kornbluh et al. ..... 310/317
2003/0028287 A1 * 2/2003 Puskas ..... 700/266
2003/0067245 A1 * 4/2003 Pelrine et al. ..... 310/311
2004/0055293 A1 * 3/2004 Pistor ..... 60/527
2004/0078662 A1 * 4/2004 Hamel et al. ..... 714/22
2004/0256952 A1 * 12/2004 Puskas ..... 310/317
2005/0012434 A1 * 1/2005 Pizzochero et al. ..... 310/339
2005/0017599 A1 * 1/2005 Puskas ..... 310/317
2005/0017602 A1 * 1/2005 Arms et al. ..... 310/339
2005/0057123 A1 * 3/2005 Deng ..... 310/339
2005/0073221 A1 * 4/2005 Albsmeier et al. ..... 310/339
2005/0134149 A1 * 6/2005 Deng et al. ..... 310/339
2005/0206275 A1 * 9/2005 Radziemski et al. ..... 310/339
2005/0274176 A1 * 12/2005 Thiesen et al. ..... 73/146
2005/0275581 A1 * 12/2005 Grassl et al. ..... 341/173
2006/0021261 A1 * 2/2006 Face ..... 36/132
2006/0131996 A1 * 6/2006 Choi et al. ..... 310/323.17
2006/0187743 A1 * 8/2006 Carreras ..... 366/111
2006/0192465 A1 * 8/2006 Kornbluh et al. ..... 310/800
2006/0237968 A1 * 10/2006 Chandrasekaran ..... 290/1 R
2006/0238079 A1 * 10/2006 Pei et al. ..... 310/339
2006/0275883 A1 * 12/2006 Rathgeber et al. ..... 435/173.1
2007/0007827 A1 * 1/2007 Harris et al. ..... 310/15
2007/0087930 A1 * 4/2007 Priya ..... 501/134
2007/0170820 A1 * 7/2007 Bromfield ..... 310/364
2007/0257634 A1 * 11/2007 Leschin et al. ..... 320/107
2007/0284969 A1 * 12/2007 Xu ..... 310/339
2008/0067893 A1 * 3/2008 Peacock ..... 310/322
2008/0074002 A1 * 3/2008 Priya et al. ..... 310/339
2008/0084138 A1 * 4/2008 Micallef ..... 310/339
2008/0092354 A1 * 4/2008 Clingman et al. ..... 29/25.35
2008/0100178 A1 * 5/2008 Clingman ..... 310/330
2008/0100179 A1 * 5/2008 Ruggeri et al. ..... 310/332
2008/0100181 A1 * 5/2008 Clingman et al. ..... 310/339
2008/0129153 A1 * 6/2008 Roundy et al. ..... 310/339
2008/0143214 A1 * 6/2008 McNamara et al. ..... 310/318
2008/0203850 A1 * 8/2008 Martineau ..... 310/309
2008/0204005 A1 * 8/2008 Wang ..... 324/207.15
2008/0238260 A1 * 10/2008 Xu et al. ..... 310/339
2008/0246439 A1 * 10/2008 Tsui et al. ..... 320/137
2008/0252174 A1 * 10/2008 Mohammadi et al. ..... 310/319
2008/0297340 A1 * 12/2008 Popa et al. ..... 340/539.1
2009/0085409 A1 * 4/2009 Kearney-Fischer et al. . 307/115
2009/0085444 A1 * 4/2009 Alvarez Icaza Rivera et al. ..... 310/365
2009/0120200 A1 * 5/2009 Chakrabartty ..... 73/808
2009/0127976 A1 * 5/2009 Ward et al. ..... 310/319
2009/0152873 A1 * 6/2009 Gangopadhyay et al. ... 290/1 R
2009/0160292 A1 * 6/2009 Whinnery ..... 310/319
2009/0195124 A1 * 8/2009 Abramovich et al. ..... 310/339
2009/0195222 A1 * 8/2009 Lu et al. ..... 322/3
2009/0195226 A1 * 8/2009 Abramovich et al. ..... 322/2 R
2009/0200896 A1 * 8/2009 Morris et al. ..... 310/321
2009/0212665 A1 * 8/2009 Koser et al. ..... 310/339
2009/0261689 A1 * 10/2009 Fang ..... 310/319
2009/0315335 A1 * 12/2009 Ujihara et al. ..... 290/1 R
2009/0322184 A1 * 12/2009 Carman et al. ..... 310/339
2010/0007246 A1 * 1/2010 Laermer et al. ..... 310/330
2010/0033060 A1 * 2/2010 Laermer et al. ..... 310/339
2010/0045111 A1 * 2/2010 Abramovich et al. ..... 307/43
2010/0052324 A1 * 3/2010 Priya ..... 290/50
2010/0072759 A1 * 3/2010 Andosca et al. ..... 290/1 R
2010/0090477 A1 * 4/2010 Keating et al. ..... 290/1 R
2010/0102782 A1 * 4/2010 Thiesen et al. ..... 320/166
2010/0109486 A1 * 5/2010 Polyakov et al. ..... 310/365
2010/0148519 A1 * 6/2010 Shih et al. ..... 290/1 R
2010/0187832 A1 * 7/2010 Holland et al. ..... 290/1 A
2010/0187835 A1 * 7/2010 Hohlfeld et al. ..... 290/1 R
2010/0219720 A1 * 9/2010 Namuduri et al. ..... 310/319
2010/0219721 A1 * 9/2010 Namuduri et al. ..... 310/339
2010/0294976 A1 * 11/2010 Ajayan et al. ..... 252/62.9 PZ
2010/0308592 A1 * 12/2010 Frayne ..... 290/54
2010/0314968 A1 * 12/2010 Mohamadi ..... 310/319
2011/0023592 A1 * 2/2011 Hortig et al. ..... 73/146.5
2011/0023727 A1 * 2/2011 Deane et al. ..... 99/453
2011/0023728 A1 * 2/2011 Deane et al. ..... 99/483

(56) References Cited

U.S. PATENT DOCUMENTS

| | | | | |
|---|---|---|---|---|
| 2011/0074162 | A1* | 3/2011 | Cottone et al. | 290/1 R |
| 2011/0084503 | A1* | 4/2011 | Li et al. | 290/1 R |
| 2011/0109200 | A1* | 5/2011 | Jenninger et al. | 310/338 |
| 2011/0115335 | A1* | 5/2011 | Pelletier | 310/318 |
| 2011/0121583 | A1* | 5/2011 | Asturias et al. | 290/1 R |
| 2011/0127881 | A1* | 6/2011 | Howarth | 310/319 |
| 2011/0133598 | A1* | 6/2011 | Jenninger et al. | 310/311 |
| 2011/0140577 | A1* | 6/2011 | Galchev et al. | 310/339 |
| 2011/0163636 | A1* | 7/2011 | Sirbuly et al. | 310/339 |
| 2011/0188337 | A1* | 8/2011 | Rathgeber et al. | 366/108 |
| 2011/0192016 | A1* | 8/2011 | Kang et al. | 29/592.1 |
| 2011/0204653 | A1* | 8/2011 | Liu et al. | 290/1 R |
| 2011/0210554 | A1* | 9/2011 | Boysel | 290/50 |
| 2011/0215590 | A1* | 9/2011 | Arnold et al. | 290/1 R |
| 2011/0252845 | A1* | 10/2011 | Webb et al. | 70/101 |
| 2011/0260584 | A1* | 10/2011 | Yu et al. | 310/339 |
| 2011/0278986 | A1* | 11/2011 | Campbell | 310/319 |
| 2011/0285131 | A1* | 11/2011 | Kwon et al. | 290/50 |
| 2011/0291526 | A1* | 12/2011 | Abramovich et al. | 310/339 |
| 2012/0019009 | A1* | 1/2012 | Fong et al. | 290/1 R |
| 2012/0038249 | A1* | 2/2012 | Lu et al. | 310/338 |
| 2012/0043858 | A1* | 2/2012 | Mahapatra et al. | 310/339 |
| 2012/0049692 | A1* | 3/2012 | Boyd et al. | 310/319 |
| 2012/0055257 | A1* | 3/2012 | Shaw-Klein | 73/780 |
| 2012/0068572 | A1* | 3/2012 | Jenninger et al. | 310/300 |
| 2012/0068576 | A1* | 3/2012 | Lee | 310/339 |
| 2012/0119620 | A1* | 5/2012 | Xu et al. | 310/328 |
| 2012/0126663 | A1* | 5/2012 | Jenninger et al. | 310/311 |
| 2012/0126959 | A1* | 5/2012 | Zarrabi et al. | 340/407.1 |
| 2012/0139389 | A1* | 6/2012 | Bohringer et al. | 310/300 |
| 2012/0181796 | A1* | 7/2012 | Mansfield et al. | 290/1 R |
| 2012/0181901 | A1* | 7/2012 | Krupenkin et al. | 310/339 |
| 2012/0194039 | A1* | 8/2012 | Jenninger et al. | 310/365 |
| 2012/0206016 | A1* | 8/2012 | Ayazi et al. | 310/339 |
| 2012/0206017 | A1* | 8/2012 | Karkkainen et al. | 310/339 |
| 2012/0206248 | A1* | 8/2012 | Biggs | 340/407.2 |
| 2012/0222854 | A1* | 9/2012 | McClung, III | 166/75.12 |
| 2012/0245408 | A1* | 9/2012 | Shen et al. | 600/25 |
| 2012/0250456 | A1* | 10/2012 | Tenghamn | 367/20 |
| 2012/0267899 | A1* | 10/2012 | Huffman et al. | 290/1 R |
| 2012/0267900 | A1* | 10/2012 | Huffman et al. | 290/1 R |
| 2012/0267982 | A1* | 10/2012 | Carman et al. | 310/318 |
| 2012/0280516 | A1* | 11/2012 | Moss | 290/1 R |
| 2012/0286522 | A1* | 11/2012 | Stahlkopf et al. | 290/1 R |
| 2012/0299514 | A1* | 11/2012 | Anderson et al. | 318/116 |
| 2012/0315364 | A1* | 12/2012 | Champlin et al. | 426/522 |
| 2012/0326565 | A1* | 12/2012 | Kuisma et al. | 310/329 |
| 2013/0026766 | A1* | 1/2013 | Ocalan et al. | 290/1 R |
| 2013/0161957 | A1* | 6/2013 | Bhat et al. | 290/53 |
| 2013/0193930 | A1* | 8/2013 | Baugher | 320/137 |
| 2013/0207520 | A1* | 8/2013 | Near | 310/339 |
| 2013/0207793 | A1* | 8/2013 | Weaber et al. | 340/407.2 |
| 2014/0182378 | A1* | 7/2014 | Loverich et al. | 73/514.29 |
| 2014/0184024 | A1* | 7/2014 | Loverich et al. | 310/328 |

OTHER PUBLICATIONS

Scott Meninger, Jose Oscar Mur-Miranda, Rajeevan Amirtharajah, Anantha P. Chandrakasan, Jeffrey H. Lang; "Viration-to-Electric Energy Conversion", IEEE Transactions of Very Large Scale Integration (VLSI) Systems, vol. 9, No. 1, Feb. 2001.

Parker Racor, "Diesel Fuel Heaters Products & Problem/ Solution" Parker Hannifin Corporation Brochure No. 7749USA Dec. 2007.

Shad Roundy, Paul K. Wright, Kristofer S. J. Pister, "Micro-Electrostatic Vibration-to-Electricity Converters", Proceedings of IMECE2002, ASME International Mechanical Engineering Congress & Exposition, Nov. 17-22, 2002, New Orleans, Louisiana.

Felipe Jerez, Grupo Premo; "Platform design for testing vibration to electrical power generators" Mar. 25, 2011 6:59am EDT, http://www.eetimes.com/General/PrintView/4214485, printed Oct. 6, 2012 3:58pm.

Vindo Challa, M.G. Prasad, Yong Shi, Frank Fisher; "Piezoelectric-Based Vibration Energy Harvesting", Department of Mechanical Engineering Stevens Institute of Technology, Hoboken, NJ, printed from web Oct. 12, 2012.

R.J.M. Vullers, R. Van Schaijk, I. Doms, C. Van Hoof, R. Mertens, "Micropower energy harvesting", Solid-State Electronics 53 (2009) 684-693.

* cited by examiner

ENERGY HARVESTING CONTAINER

FIELD OF THE INVENTION

The present application relates generally to vibrational energy harvesting heaters in double container systems for heating fluid or other substances in the inner container using relative motion between the inner container and outer container.

BACKGROUND OF THE INVENTION

Double container systems are used for various purposes. An example non-limiting purpose is for fluid bottles to keep the fluid insulated and thus less likely to cool when in the inner container, owing to the insulative qualities of the arrangement. As understood herein, such fluid still cools down. As also understood herein, many such double container systems are intended to be used in moving and vibrational environments, and principles of this application leverage that fact.

SUMMARY OF THE INVENTION

Although a simple fluid container system is used as an example environment in which present principles may be employed, it is to be understood that present principles apply equally to other container systems, indeed, which may seek to keep not only fluid warm but also foodstuffs or other substances. For example, present principles may be used in containers on trucks or other vehicles that hold diesel or other fuel, to increase the temperature of the diesel or other fuel.

Accordingly, a container system has an outer container and an inner container defining a chamber for holding an item to be heated. The inner container is movable within the outer container when the container system vibrates or is subject to accelerations. One or more magnets are supported by the outer container and are electromagnetically coupled to at least a portion of the inner container to generate heat within the chamber when there is relative motion between the inner and the outer container.

In another embodiment a piezoelectric generator is connected to the end of the inner container, which mechanically impacts the outer container causing electrical current to be generated when impacted. The generated electrical current is feed into the attached coil that is wound around the inner container thereby heating the inner container and the contents.

If desired, a spring may be sandwiched between the respective bottoms of the containers to promote relative motion between the containers. In some embodiments an elastic joining element such as a rubber or plastic boot couples the inner container to the outer container.

In some implementations the inner container has no heater element and is ferromagnetic. In other implementations a heater element is within the chamber for generating heat under the influence of current flowing there through responsive to relative motion between the heater element and magnet. No coils may be interposed between the heater element and the magnet. Or, an outer pickup coil may surround the inner container and is electrically connected to the heater element.

In another aspect, an apparatus that experiences vibrations when transported includes a first inner container which defines a chamber configured for holding a substance. One or more magnets that do not move with the first container are juxtaposed with the first container to cause an electrical current to be introduced on or in the first container when the first container moves relative to the magnet. The electrical current is dissipated as heat to transfer heat into the substance in the chamber.

In another aspect, an apparatus that experiences movements when transported includes a first inner container which defines a chamber configured for holding a substance and an energy transducer that does not move with the first container. The energy transducer is juxtaposed with the first container to transform motion between the energy transducer and the first container to heat which is introduced on or in the first container when the first container moves relative to the energy transducer. The energy transducer may be a piezoelectric element or an electro-magnetic combination including a magnet.

The details of the present invention, both as to its structure and operation, can best be understood in reference to the accompanying drawings, in which like reference numerals refer to like parts, and in which:

DETAILED DESCRIPTION OF THE PREFERRED EMBODIMENT

Figure 1:
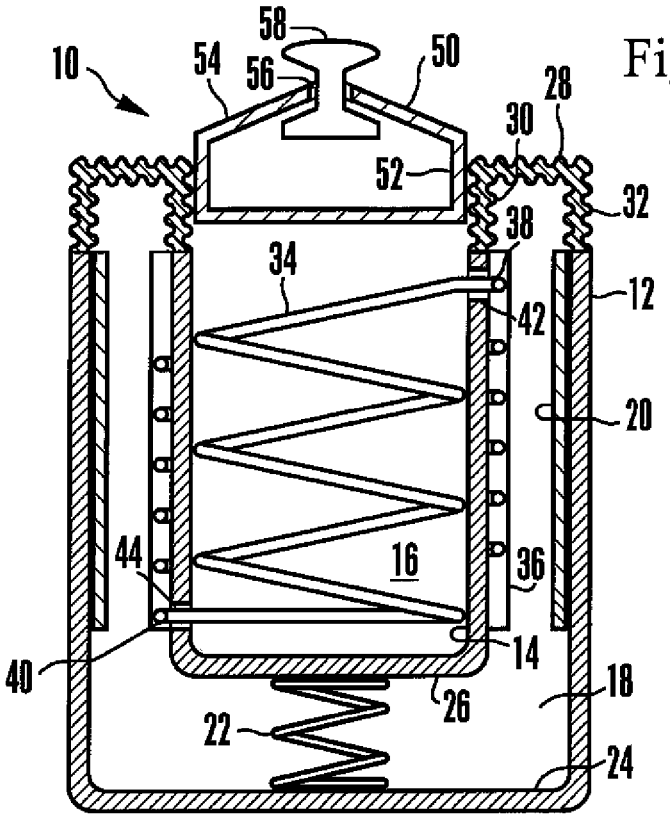
FIG. 1 is a cross-sectional view in elevation of a first embodiment in which a cylindrical magnet in an outer container of a double container system is coupled to a heater coil within an inner fluid container of the system through an outer coil that surrounds the inner container and that is connected to the heater coil, with a bottom spring to promote vibration between the two containers, with some details of the upper closure not shown in cross-section.

Referring initially to FIG. 1, a container system 10 includes an outer container 12 and an inner container 14 defining a chamber 16 for holding an item to be heated. In the example shown, the containers 12, 14 are coaxial with each other and the inner container 14 is substantially enclosed by the outer container 12 except at the top of the inner container. The outer container may be plastic, metal such as aluminum or steel, or a composite material. The inner container 14 may be plastic, metal such as aluminum or steel, or a composite material. Typically, the inner container is thermally insulative and an insulating air gap 18 may be established between the side walls of the containers 12, 14 as shown. The containers 12, 14 may have cylindrical side walls as shown.

In the embodiment shown in FIG. 1, the inner container 14 is movable and more preferably is axially reciprocable within the outer container 12 when the container system 10 vibrates. This is important in the example of FIG. 1 because one or more magnets 20 are supported by the outer container 12 and are electromagnetically coupled a portion of the inner container 14 to generate heat within the chamber 16 when the inner container 14 moves relative to the outer container 12. In the example shown, the magnet 20 is a single cylindrical magnet that is supported on the inside side wall of the outer container 12, extending axially more than half the length of the inner container 14 as shown. However, as discussed further below one or more bar magnets may be used. When no outer container is provided the magnet 20 may be mounted outside the inner container 14 on a nearby surface with which the inner container 12 moves relatively under the influence of vibrations. The magnet 20 may be mounted by means of fasteners such as screws or by adhesives or other means.

Figure 2:
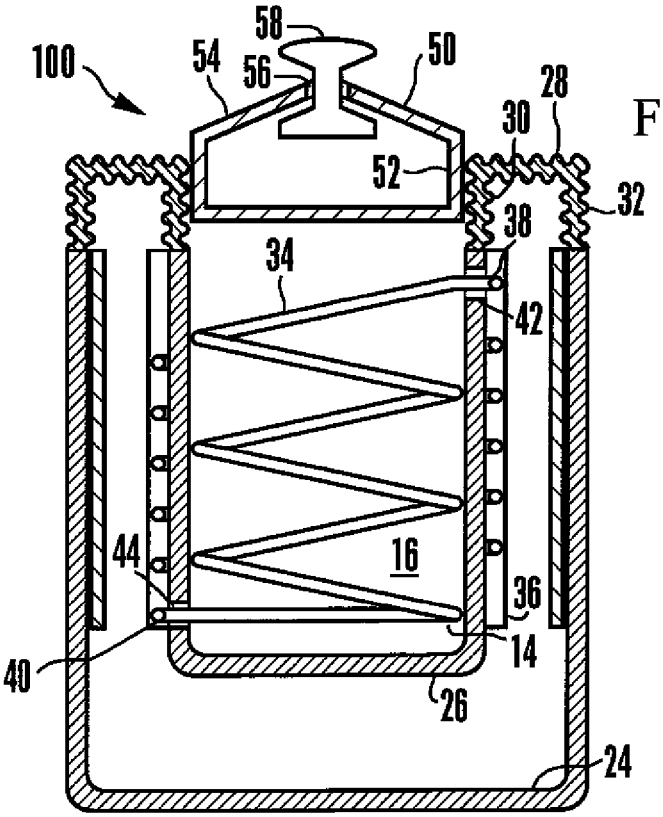
FIG. 2 is a cross-sectional view in elevation of a second embodiment that is in all essential respects identical too the first embodiment shown in FIG. 1 except the bottom spring is omitted, with some details of the upper closure not shown in cross-section.

To promote vibrational reciprocation of the inner container 14 relative to the outer container 12, a spring 22 may be sandwiched between the containers to promote relative motion between the containers. In the embodiment of FIG. 1 the containers define respective bottoms 24, 26 and the spring 22 is sandwiched between the bottoms 24, 26. The spring may be a coil spring in compression or a leaf spring or indeed other spring structure such as a resilient foam layer. However, FIG. 2 shows a container system 100 that in all essential respects is identical to the container system 10 shown in FIG. 1 except no spring is included.

On the opposite ends of the containers 12, 14, the containers 12, 14 may be joined, in the example of FIG. 1, by an elastic joining element 28. In the embodiment shown, the elastic joining element 28 is a rubber or plastic boot that is ring-shaped and that connects the open circular top periphery 30 of the inner container 14 to the open circular top periphery 32 of the outer container 12 as shown. It may now be appreciated that owing to this elastic coupling the inner container 14 can move axially in the outer container 12 when the container system 10 is subject to vibrations.

In the embodiment shown in FIG. 1, a heater element 34 is disposed within the chamber 16 for generating heat under the influence of current flowing there through responsive to relative motion between the heater element 34 and magnet 20. In the embodiment shown, the heater element 34 includes a coil of resistive wire arranged in a cylindrical pattern on the inside side wall of the inner container 14. The heater element may be made of steel, tungsten, or indeed even copper but it is preferable that the heater wire be made of material that is more electrically resistive rather than less to promote the generation of dissipative heat when electrical current passes through the heater element. The wire or wires of the heater element may be embedded in a cylindrical thin plastic sleeve and bonded to the inside surface of the inner container 14 for convenience.

In the embodiment of FIG. 1, an outer pickup coil 36 surrounds the inner container 14. The pickup coil 36, which may be wrapped around the outside of the cylindrical side wall of the inner container 14 as shown, is electrically connected to the heater element. In the example shown, the pickup coil 36 is connected to the heater element 34 via upper and lower leads 38, 40 which respectively extend through upper and lower side channels 42, 44 formed in the inner container 14. In other embodiments the inner container 14 may be electrically conductive and the pickup coil 36 may be connected to the heater element 34 through the inner container 14 material.

Figure 3:
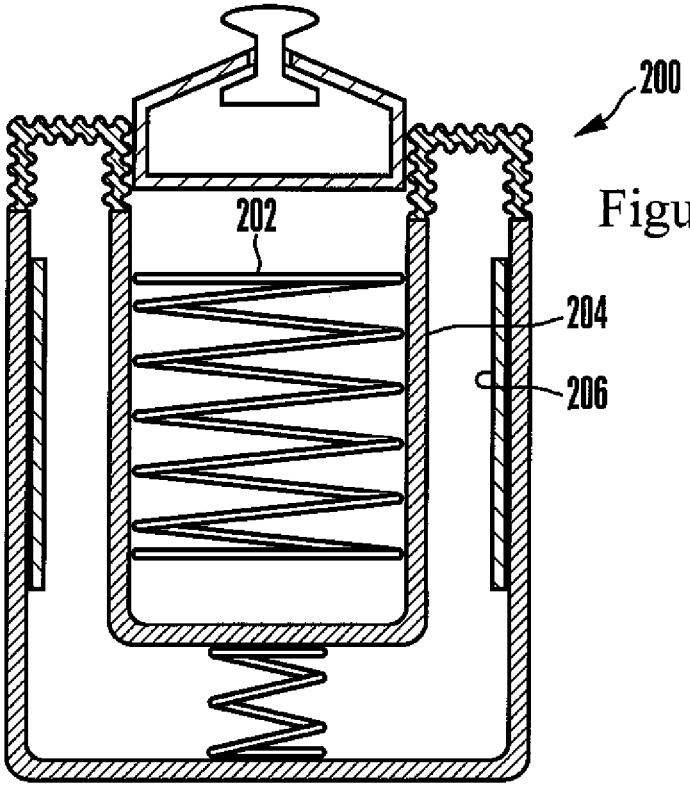
FIG. 3 is a cross-sectional view in elevation of a third embodiment in which a magnet in an outer container of a double container system is coupled to a heater coil within an inner fluid container of the system directly through the magnetically permeable wall of the inner container, with some details of the upper closure not shown in cross-section.

Briefly referring to FIG. 3, a container system 200 is in all essential respects is identical to the container system 10 shown in FIG. 1 except that no pickup coil is interposed between a heater element 202 within the inner container 204 and a magnet 206. In this embodiment the inner container 204 is magnetically permeable so that the magnet 206 is electromagnetically coupled directly to the heater element 202.

Figure 4:
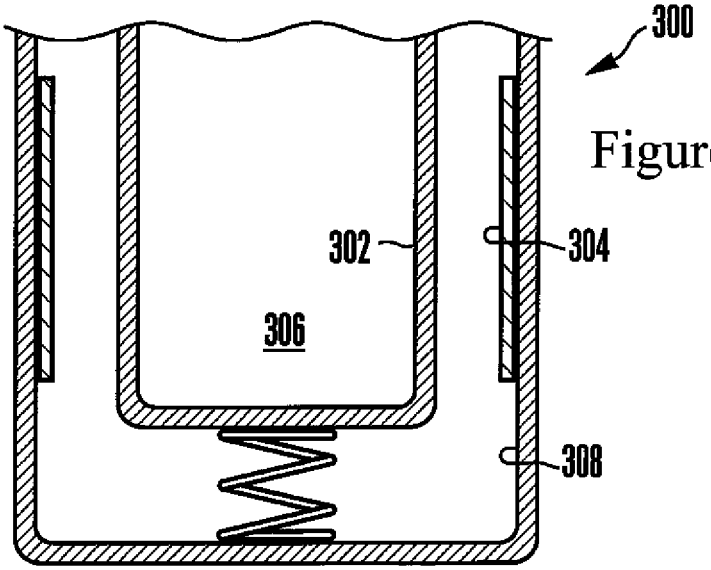
FIG. 4 is a cross-sectional view in elevation of a fourth embodiment in which strip magnets in an outer container of a double container system are directly coupled to the wall of a ferromagnetic inner fluid container of the system, with portions of the upper closure cut away for clarity.

FIG. 4 takes it a step farther, in which a container system 300 includes no pickup coil and no heater element. Instead, an inner container 302 is ferromagnetic so that the magnetic coupling is between a magnet 304 and the inner container 302 walls, generating current in the walls that is dissipated as heat into the chamber 306 when the inner container 302 vibrates relative to an outer container 308. Note that another difference between the systems 10 and 300 of FIGS. 1 and 4 is that plural elongated bar magnets are used to establish the magnet 304 in FIG. 1.

Referring back to FIG. 1, particularly when the substance within the chamber 16 is a liquid for applications in which the container system 10 is mounted on a bicycle or other moving conveyance, a closure 50 is provided to close the open end of the inner container 14. In the example shown the closure 50 includes a cylindrical stopper 52 merging into inwardly tapering upper shoulders 54 and terminating at an opening 56, which may be selectively blocked by a familiar plunger-type device 58. Alternatively, the closure 50 may be threadably engaged with the neck of the outer container 14.

Figure 5:
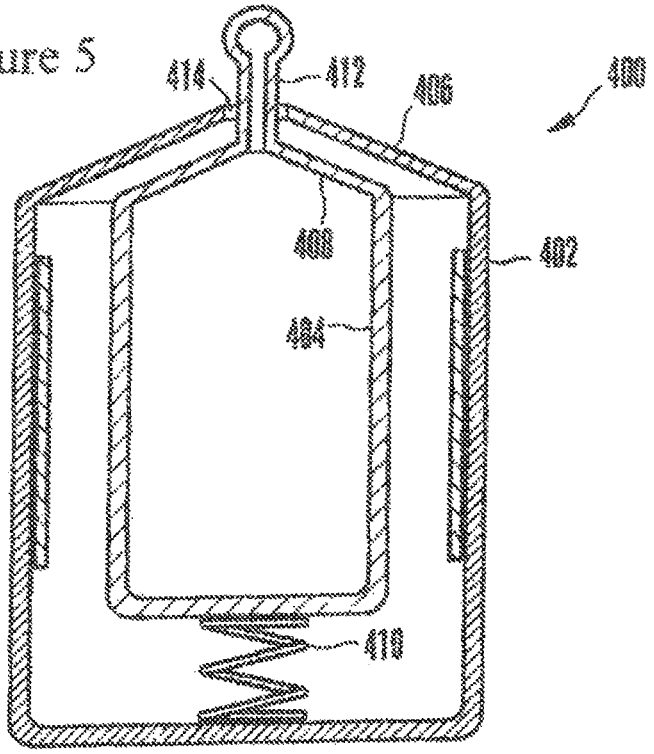
FIG. 5 is a cross-sectional view in elevation of an embodiment in which magnets in an outer container of a double container system are directly coupled to the wall of a ferromagnetic inner fluid container of the system, with the upper ends of the containers not being coupled using elastic structure but rather freely movable relative to each other, showing an optional bottom spring.

Having completed the description of FIG. 1 and having attended to FIGS. 2-4, attention is now drawn to FIG. 5, which shows a container system 400 in which an outer container 402 supports an inner container 404, but in which the upper peripheries of the containers 402, 404 are not coupled together by an elastic boot. Instead, the upper portions 406, 408 of the containers 402, 404, which may taper inwardly and upwardly as shown to establish slanted shoulders, are spaced from each other and are not connected together at all. The only limit to the upward motion of the inner container 404 within the outer container 402 is by operation of the outside surface of the upper portion 408 of the inner container 404 abutting the inside surface of the upper portion 406 of the outer container 402.

If it is desired to couple the containers 402, 404 together, a bottom spring 410 may be disposed between the container bottoms as shown, although this spring is optional. In effect, the inner container 404 may be allowed to freely move within the outer container 402 constrained only by the walls of the outer container 402. The upper open neck 412 of the inner container 404 may extend upwardly beyond a top opening 414 in the outer container 402 if desired, a configuration that may be implemented in any of the previous embodiments where appropriate.

Figure 6:
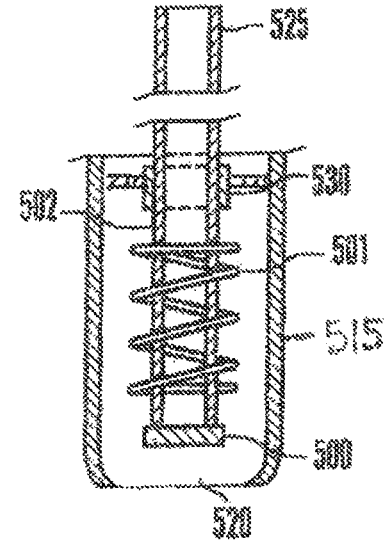
FIG. 6 shows an alternate embodiment using piezoelectric principles.

FIG. 6 illustrates an embodiment of the present invention employing a piezo-electric generator. Illustrated is an inner container 502, with the piezo-electric generator 500, attached to the end portion of the inner-container. Attached to the piezo electric generator 500, is a coil assembly 501. There are two leads coming from the piezo-electric generator 500, to the coil assembly 501. An outer-container 515 comprises a flexible supporting neck 530 that attaches the inner-container to the outer-container but allows for vibrational motion between the two components. The outer container comprises an end surface, 520, which communicate with the piezo-electric generator 500, and a cap 525, for securing to the container system.

When the system is subjected to motion, the inner container 502, is allowed to move relative to the outer-container 515, by means of the flexible supporting neck element 530, which allows for a degree of inertial isolation between the inner container 502, and the outer container 515. The piezo-electric generator 500 is attached to the end of the inner container 502 which when subjected to accelerations and vibrational motion impacts with the end of portion 520 of the outer container assembly 515. These impacts are converted to electro-motive forces in the piezo electric generator 500, which powers the coil assembly 501, thereby heating the inner-container 502 and the contents contained therein.

Figure 7:
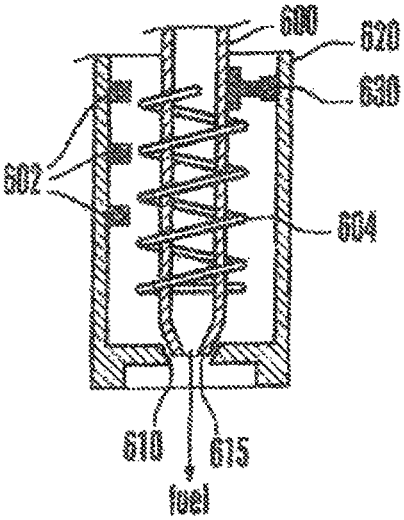
FIG. 7 illustrates a system for heating diesel fuel.

FIG. 7 illustrates an embodiment of present principles for use in a diesel fuel tank or fuel tank for use in transportation vehicles such as cars, trucks, airplanes, and ships. The system heats the fuel so to provide improved operations especially in cold environments.

The fuel tank comprises an inner container 600, which contains the fuel, and an outer-assembly 620, which has attached to its inside a set of permanent magnets 602 and provides the mechanical attachments to the vehicle. A coil system 604, is wrapped around the inner-container 600 and is connected to a resistive heater 610 that is located on the neck of the inner container 600, as illustrated. Connecting the inner-container to the outer-assembly is the flexible neck element 615. Illustrated is a mechanical roller guide arrangement 630 allowing the two moving parts to translate smoothly.

The inner-container has a coil system 604 which communicates with the magnetic system, 602, thereby generating electro-motive force which is applied to the resistive heater 610 located at the neck output of the fuel tank.

While the particular ENERGY HARVESTING CONTAINER is herein shown and described in detail, it is to be understood that the subject matter which is encompassed by the present invention is limited only by the claims.

What is claimed is:

1. An apparatus that experiences movements when transported, comprising:

a first container which defines a chamber configured for holding a substance;

at least one energy transducer coupled to the first container to transform motion of the first container to output which is introduced on or in the first container when the first container moves;

an electrical connection between the energy transducer and the inner container to transmit the output of the energy transducer to the inner container to thereby heat the inner container; and an outer container enclosing the first container and movably engaged with the first container such that as the apparatus vibrates the outer container moves into contact with the energy transducer to cause the transducer to generate the output.

2. The apparatus of claim 1, comprising a spring sandwiched between the containers to promote relative motion between the containers.

3. The apparatus of claim 2, wherein the containers define respective ends and the spring is sandwiched between the ends.

4. The apparatus of claim 1, comprising an elastic joining element coupling the first container to the outer contain.

5. The apparatus of claim 4, wherein the elastic joining element is a rubber or plastic boot connecting a top of the first container to the outer container.

6. The apparatus of claim 1, wherein the first container is ferromagnetic.

7. The apparatus of claim 1, wherein the energy transducer includes a magnet and a heater element within the chamber and generating heat under the influence of current flowing therethrough responsive to relative motion between the heater element and magnet.

8. The apparatus of claim 7, wherein no coils are interposed between the heater element and the magnet.

9. The apparatus of claim 1, wherein the energy transducer is a piezoelectric element.

10. The apparatus of claim 1, wherein the energy transducer is mounted to a bottom end of the first container, facing a bottom surface of the outer container.

* * * * *